US011500321B2

(12) United States Patent
Nakamura et al.

(10) Patent No.: US 11,500,321 B2
(45) Date of Patent: Nov. 15, 2022

(54) IMAGE-FORMING APPARATUS INCLUDING STRUCTURE FOR SWITCHING TRANSMISSION STATE OF DRIVING FORCE TO PHOTOSENSITIVE DRUM

(71) Applicant: BROTHER KOGYO KABUSHIKI KAISHA, Nagoya (JP)

(72) Inventors: Kazutoshi Nakamura, Kuwana (JP); Tomitake Aratachi, Toyokawa (JP); Sota Hirano, Kasugai (JP); Kazuma Hinoue, Nagoya (JP); Shintaro Suzuki, Nagoya (JP); Ayaka Komori, Nagoya (JP); Marika Ozaki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/321,910

(22) Filed: May 17, 2021

(65) Prior Publication Data

US 2021/0356900 A1 Nov. 18, 2021

(30) Foreign Application Priority Data

May 18, 2020 (JP) ..... JP2020-086816
May 18, 2020 (JP) ..... JP2020-086817

(51) Int. Cl.
*G03G 15/00* (2006.01)

(52) U.S. Cl.
CPC ..... *G03G 15/757* (2013.01)

(58) Field of Classification Search
CPC ..... G03G 15/757; G03G 2215/2045
See application file for complete search history.

(56) References Cited

U.S. PATENT DOCUMENTS

2002/0098013 A1* 7/2002 Kamimura ..... G03G 15/0806 399/167
2003/0047407 A1* 3/2003 Murano ..... F16D 27/115 192/84.1
2003/0190172 A1* 10/2003 Makino ..... G03G 15/5008 399/167
2010/0303502 A1 12/2010 Miwa
2012/0243910 A1 9/2012 Aratachi et al.
(Continued)

FOREIGN PATENT DOCUMENTS

JP 2001-199610 A 7/2001
JP 2002-189322 A 7/2002
(Continued)

*Primary Examiner* — Sevan A Aydin
(74) *Attorney, Agent, or Firm* — Merchant & Gould P.C.

(57) ABSTRACT

An image-forming apparatus includes: a photosensitive drum, a motor, and a drum gear train configured to transmit a driving force from the motor to the photosensitive drum. The drum gear train includes a first gear, a second gear and a first clutch. The first gear is rotatable about a first axis upon receipt of the driving force. The second gear is rotatable about the first axis and configured to receive the driving force from the first gear and to transmit the driving force to the photosensitive drum. The first clutch is switchable between a first transmission state where the driving force is transmitted from the first gear to the second gear and a first transmission cutoff state where the transmission of the driving force from the first gear to the second gear is cut off.

26 Claims, 9 Drawing Sheets

12B

(56) References Cited

U.S. PATENT DOCUMENTS

| | | | | |
|---|---|---|---|---|
| 2015/0277261 | A1 | 10/2015 | Suzuki | |
| 2016/0053859 | A1* | 2/2016 | Tamura | G03G 21/1647 399/167 |
| 2016/0349664 | A1 | 12/2016 | Sawashima | |
| 2017/0269536 | A1* | 9/2017 | Watanabe | F16H 3/54 |
| 2018/0074446 | A1* | 3/2018 | Izumi | G03G 15/2039 |
| 2018/0180106 | A1* | 6/2018 | Hara | F16D 11/04 |

FOREIGN PATENT DOCUMENTS

| | | | | | |
|---|---|---|---|---|---|
| JP | 2002-268503 | A | | 9/2002 | |
| JP | 2008-101644 | A | | 5/2008 | |
| JP | 2010-275075 | A | | 12/2010 | |
| JP | 2012-203009 | A | | 10/2012 | |
| JP | 2015-191210 | A | | 11/2015 | |
| JP | 2016-224418 | A | | 12/2016 | |
| JP | 2017083006 | A | * | 5/2017 | |
| JP | 2017-166596 | A | | 9/2017 | |
| JP | 2017167382 | A | * | 9/2017 | |
| JP | 2020118202 | A | * | 8/2020 | G03G 15/757 |

* cited by examiner

IMAGE-FORMING APPARATUS INCLUDING STRUCTURE FOR SWITCHING TRANSMISSION STATE OF DRIVING FORCE TO PHOTOSENSITIVE DRUM

CROSS REFERENCE TO RELATED APPLICATION

This application claims priorities from Japanese Patent Application Nos. 2020-086816 filed May 18, 2020 and 2020-086817 filed May 18, 2020. The entire contents of the priority applications are incorporated herein by reference.

TECHNICAL FIELD

The present disclosure relates to an image-forming apparatus.

BACKGROUND

Japanese Patent Application Publication No. 2002-189322 discloses an image-forming apparatus including a photosensitive drum, a motor, and a drum gear train. The drum gear train is configured to transmit a driving force from the motor to the photosensitive drum.

Japanese Patent Application Publication No. 2012-203009 discloses an image-forming apparatus including a photosensitive drum, a developing roller, a fixing device, a motor, a developing gear train, and a controller. The developing gear train is configured to transmit a driving force from the motor to the developing roller. The developing gear train includes a clutch configured to perform switching in state thereof between a transmission state and a cutoff state. In the transmission state of the clutch, the driving force can be transmitted from the motor to the developing roller. In the cutoff state of the clutch, the transmission of the driving force to the developing roller is interrupted.

SUMMARY

In the conventional image-forming apparatus described in the '322 publication, there may be a demand that the rotation of the photosensitive drum be halted at a desired timing.

Further, in the conventional image-forming apparatus described in the '009 publication, a peripheral velocity of the developing roller is slowed down in order to avoid degradation of developing agent when an image forming operation is not performed. However, the slowing-down of the peripheral velocity of the developing roller generates a difference in peripheral velocity between the photosensitive drum and the developing roller. This velocity difference may cause friction between the photosensitive drum and the developing roller, thereby leading to degradation of the photosensitive drum.

In view of the foregoing, it is an object of the disclosure to provide an image-forming apparatus capable of stopping the rotation of the photosensitive drum at a desired timing.

It is another object of the disclosure to provide an image-forming apparatus capable of restraining degradation of the photosensitive drum.

In order to attain the above and other objects, according to one aspect, the disclosure provides an image-forming apparatus including a photosensitive drum, a motor, and a drum gear train configured to transmit a driving force from the motor to the photosensitive drum. The drum gear train includes: a first gear rotatable about a first axis upon receipt of the driving force; a second gear rotatable about the first axis; and a first clutch. The second gear is configured to receive the driving force from the first gear and to transmit the driving force to the photosensitive drum. The first clutch is switchable between a first transmission state where the driving force is transmitted from the first gear to the second gear and a first transmission cutoff state where transmission of the driving force from the first gear to the second gear is cut off.

According to another aspect, the disclosure also provides an image-forming apparatus including a photosensitive drum, a developing roller, a fixing device, a motor, a drum gear train, a developing gear train, a fixing gear train, and a controller. The fixing device includes a heater and is configured to heat a sheet at a fixing temperature. The drum gear train is configured to transmit a driving force from the motor to the photosensitive drum. The drum gear train includes: a first gear rotatable upon receipt of the driving force; a second gear configured to receive the driving force from the first gear and to transmit the driving force to the photosensitive drum; and a first clutch switchable between a first transmission state and a first transmission cutoff state. In the first transmission state of the first clutch, the driving force is transmitted from the first gear to the second gear. In the first transmission cutoff state of the first clutch, transmission of the driving force from the first gear to the second gear is cut off. The developing gear train is configured to transmit the driving force from the first gear to the developing roller. The developing gear train includes a second clutch switchable between a second transmission state where the driving force is transmitted from the first あ gear to the developing roller and a second transmission cutoff state where transmission of the driving force from the first gear to the developing roller is cut off. The fixing gear train is configured to transmit the driving force from the motor to the fixing device. The controller is configured, after the fixing temperature reaches a target temperature, to: permit the first clutch to be switched to the first transmission state to start transmitting the driving force to the photosensitive drum; and subsequently permit the second clutch to be switched to the second transmission state to start transmitting the driving force to the developing roller.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
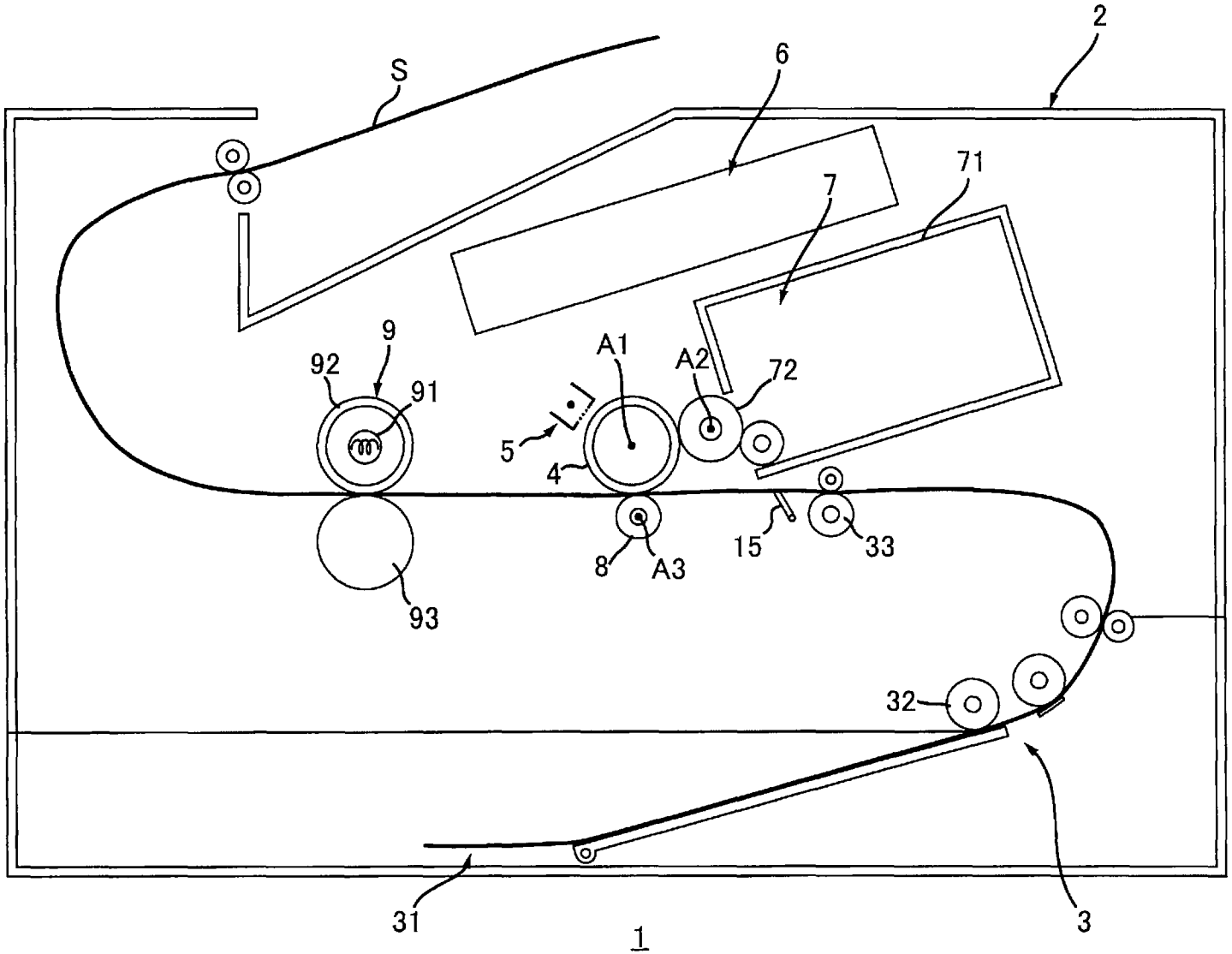
FIG. 1 is a schematic view of an image-forming apparatus according to one embodiment.

An image-forming apparatus 1 according to one embodiment of the present disclosure will be described with reference to the accompanying drawings.

1. Overview of Image-Forming Apparatus 1

An overall configuration of the image-forming apparatus 1 will be described with reference to FIGS. 1 and 2.

The image-forming apparatus 1 includes a housing 2, a sheet supply portion 3, a photosensitive drum 4, a charger 5, an exposing device 6, a developing device 7, a transferring device 8, and a fixing device 9.

The housing 2 accommodates therein the sheet supply portion 3, the photosensitive drum 4, the charger 5, the exposing device 6, the developing device 7, the transferring device 8, and the fixing device 9.

The sheet supply portion 3 is configured to supply a sheet S toward the photosensitive drum 4. The sheet supply portion 3 includes a sheet accommodating portion 31, a pick-up roller 32, and a registration roller 33. In other words, the image-forming apparatus 1 includes the registration roller 33. The sheet accommodating portion 31 is configured to accommodate therein the sheet S. The sheet S in the sheet accommodating portion 31 is configured to be fed to the photosensitive drum 4. The sheet accommodating portion 31A may be a sheet cassette, for example.

The pick-up roller 32 is configured to pick up the sheet S in the sheet accommodating portion 31. The sheet S picked up by the pick-up roller 32 is configured to be conveyed toward the registration roller 33. The registration roller 33 is positioned downstream of the pick-up roller 32 in a conveying direction of the sheet S. The registration roller 33 is configured to temporarily halt conveyance of the sheet S supplied from the pick-up roller 32, and then start conveying the sheet S toward the photosensitive drum 4 at a prescribed timing.

The photosensitive drum 4 is rotatable about a drum axis A1. The drum axis A1 extends in a first direction. As illustrated in FIG. 2, the photosensitive drum 4 includes a drum body 41 and a drum gear 42. The drum body 41 extends in the first direction along the drum axis A1. The drum body 41 has a hollow cylindrical shape. The drum gear 42 is attached to one end of the drum body 41 in the first direction. The drum gear 42 is rotatable together with the drum body 41.

The charger 5 of the present embodiment is a scorotron charger configured to charge the photosensitive drum 4. The charger 5 may be a charge roller.

The exposing device 6 is configured to expose the photosensitive drum 4 charged by the charger 5 to light. Hence, an electrostatic latent image is formed on the photosensitive drum 4. In the present embodiment, a laser scanner unit is used as the exposing device 6. However, an LED print head including an LED array is also available as the exposing device 6.

The developing device 7 includes a casing 71 and a developing roller 72. In other words, the image-forming apparatus 1 includes the developing roller 72. The casing 71 is configured to accommodate toner therein. The developing roller 72 is configured to supply the toner in the casing 71 to the photosensitive drum 4. The developing roller 72 is rotatable about a developing axis A2 extending in the first direction. The developing roller 72 extends in the first direction along the developing axis A2. The developing roller 72 has a solid cylindrical shape. The developing roller 72 is configured to contact the photosensitive drum 4.

The transferring device 8 is configured to transfer a toner image on the photosensitive drum 4 to the sheet S. The transferring device 8 of the embodiment is a transfer roller rotatable about a transfer axis A3. The transfer axis A3 extends in the first direction. The transfer roller extends in the first direction along the transfer axis A3. The transfer roller has a solid cylindrical shape. The transfer roller is configured to contact the photosensitive drum 4. Incidentally, the transferring device 8 may be a belt unit, instead of the transfer roller.

The fixing device 9 is configured to fix the toner image to the sheet S. In the present embodiment, the fixing device 9 employs a heat roller fixing system. Specifically, the fixing device 9 includes a heater 91, a heat roller 92, and a pressure roller 93. The heater 91 is positioned in an internal space of the heat roller 92. The heat roller 92 is configured to receive heat from the heater 91 and apply heat to the sheet S moving along a nip region formed between the heat roller 92 and the pressure roller 93. The pressure roller 93 is in contact with the heat roller 92. The pressure roller 93 is configured to apply pressure to the sheet S passing through the nip region in cooperation with the heat roller 92. The sheet S moved past the fixing device 9 is discharged onto an upper surface of the housing 2.

2. Details of Image-Forming Apparatus 1

The image-forming apparatus 1 according to the embodiment will be now described in details with reference to FIGS. 1 through 7.

Figure 3:
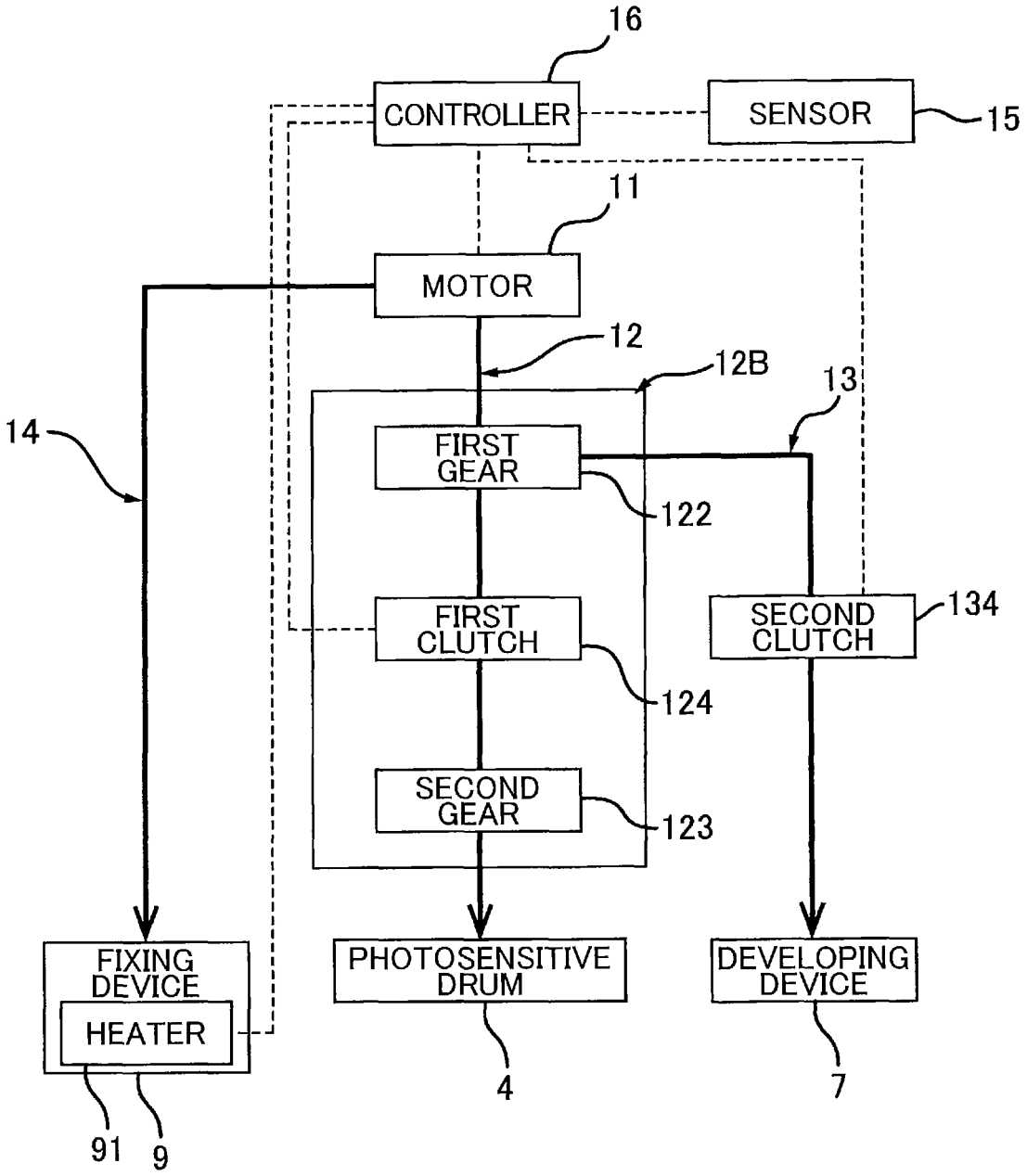
FIG. 3 is a block diagram illustrating a power transmission paths from a motor to the photosensitive drum, a developing device, and a fixing device in the image-forming apparatus according to the embodiment.

As illustrated in FIG. 3, the image-forming apparatus 1 includes a motor 11, a drum gear train 12, a developing gear train 13, a fixing gear train 14, a sensor 15, and a controller 16.

2-1. Motor 11

Figure 4:
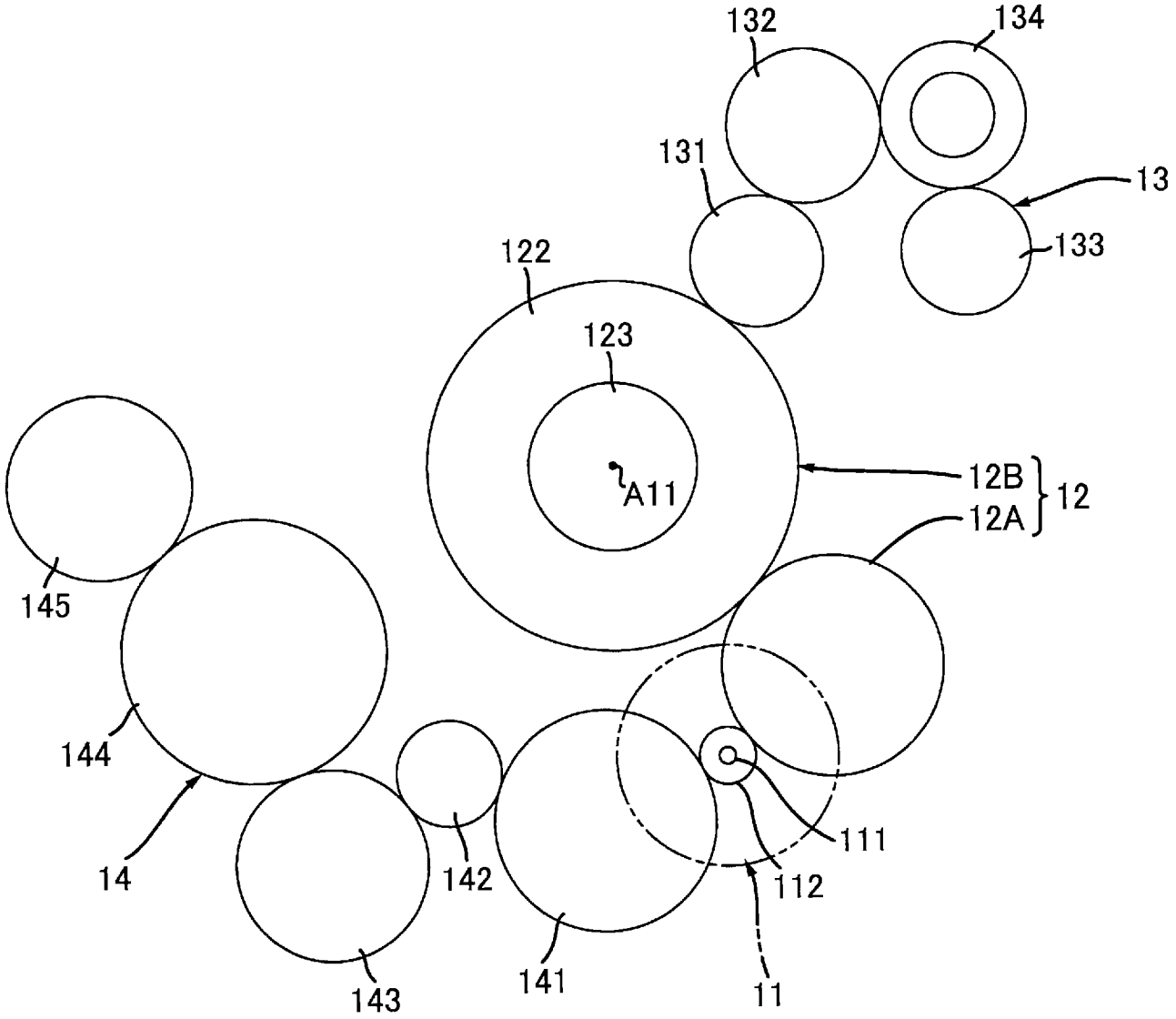
FIG. 4 is a view for description of a drum gear train, a developing gear train, and a fixing gear train those illustrated in FIG. 3.

As illustrated in FIG. 4, the motor 11 includes an output shaft 111 and an output gear 112. The output gear 112 is fixed to the output shaft 111. The output gear 112 is thus rotatable together with the output shaft 111.

2-2. Drum Gear Train 12

The drum gear train 12 is configured to transmit a driving force of the motor 11 to the photosensitive drum 4. The drum gear train 12 includes an idle gear 12A and a gear unit 12B.

The idle gear 12A is in meshing engagement with the output gear 112 of the motor 11.

The gear unit 12B includes a shaft 121 (see FIG. 5), a first gear 122, a second gear 123, a first clutch 124, a first coupling 125, and a second coupling 126. In other words, the image-forming apparatus 1 includes the shaft 121; and the drum gear train 12 includes the first gear 122, the second gear 123, the first clutch 124, the first coupling 125, and the second coupling 126.

Figure 5:
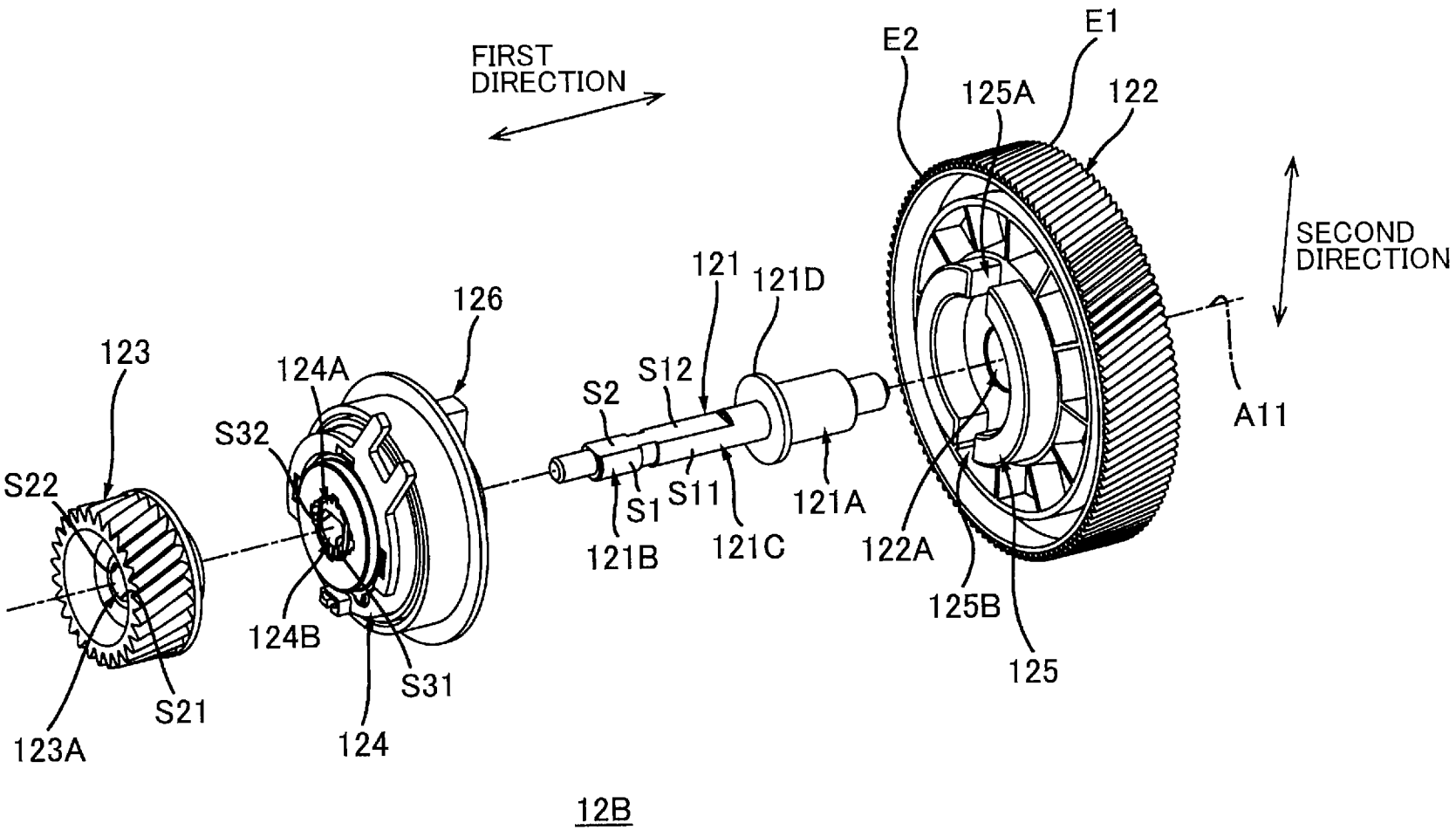
FIG. 5 is an exploded perspective view of the gear unit illustrated in FIG. 2.
Figure 6:
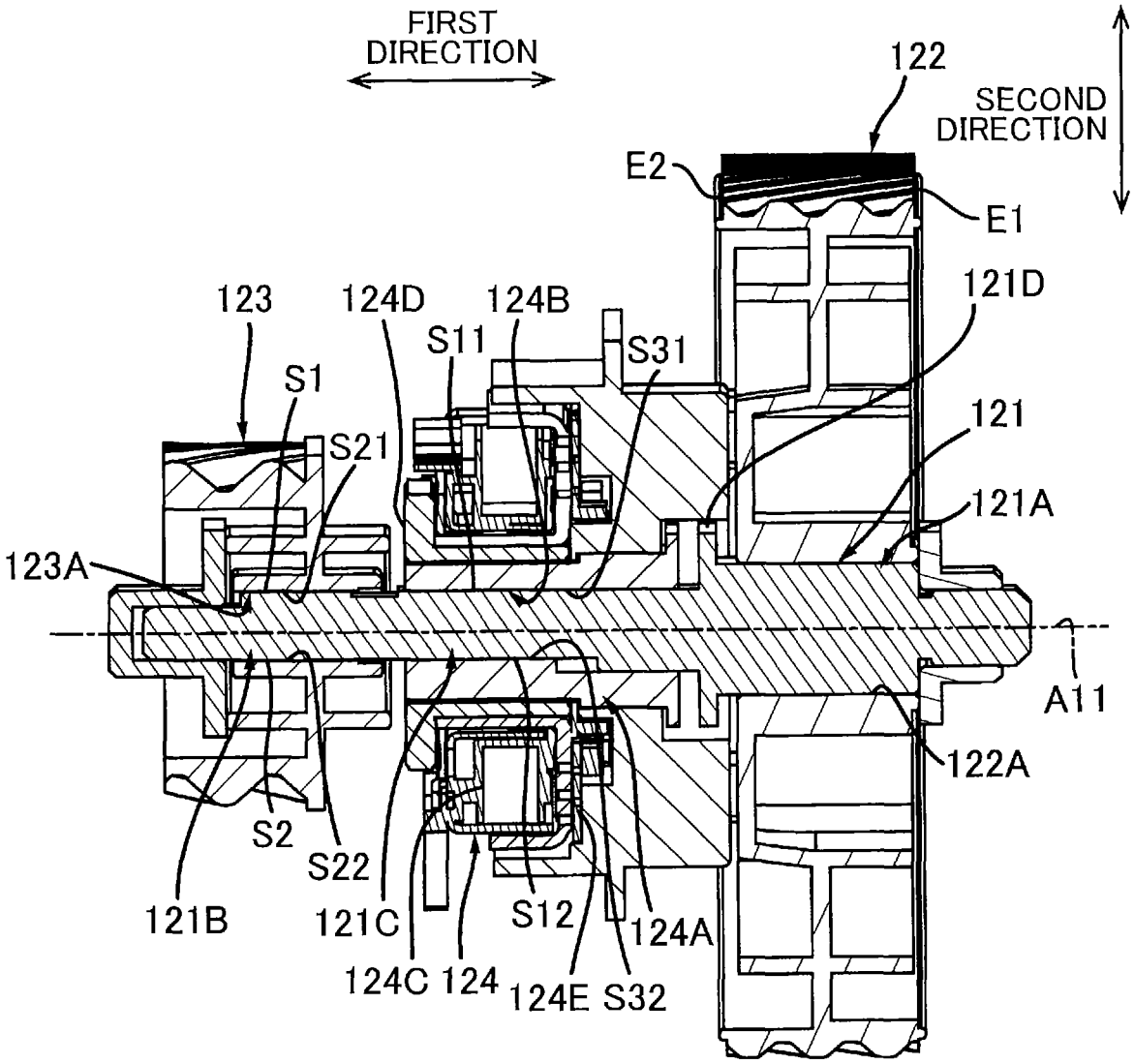
FIG. 6 is a cross-sectional view of the gear unit illustrated in FIG. 2.

As illustrated in FIGS. 5 and 6, the shaft 121 extends along a first axis A11 extending in the first direction. The shaft 121 includes a first support part 121A, a second support part 121B, a third support part 121C, and a flange 121D.

The first support part 121A supports the first gear 122. The first support part 121A constitutes one end portion of the shaft 121 in the first direction. The first support part 121A extends in the first direction. The first support part 121A has a solid cylindrical shape. The first support part 121A has a circular shape as viewed in the first direction.

The second support part 121B supports the second gear 123. The second support part 121B is positioned away from the first support part 121A in the first direction. The second support part 121B constitutes another end portion of the shaft 121 in the first direction. The second support part 121B extends in the first direction. The second support part 121B has a D-shape as viewed in the first direction. Specifically, the second support part 121B has an arcuate surface S1 and a flat surface S2. The arcuate surface S1 extends in a rotational direction of the first gear 122. The flat surface S2 extends in a radial direction of the first gear 122. The flat surface S2 extends in a direction crossing the rotational direction of the first gear 122.

The third support part 121C supports the first clutch 124. The third support part 121C is positioned between the first support part 121A and the second support part 121B in the first direction. The third support part 121C extends in the first direction. The third support part 121C has a D-shape as viewed in the first direction. Specifically, the third support part 121C has an arcuate surface S11 and a flat surface S12. The arcuate surface S11 extends in the rotational direction of the first gear 122. The flat surface S12 extends in the radial direction of the first gear 122. The flat surface S12 extends in a direction crossing the rotational direction of the first gear 122.

The flange 121D is positioned between the first support part 121A and the third support part 121C in the first direction. The flange 121D is positioned around a peripheral surface of the shaft 121. The flange 121D protrudes radially outward from the peripheral surface of the shaft 121. The flange 121D may be integral with or fixed to the peripheral surface of the shaft 121. The flange 121D has a disc-like shape. In a state where the first gear 122 is attached to the shaft 121, the flange 121D is slightly apart from the first gear 122 in the first direction.

In the state where the first gear 122 is attached to the shaft 121, the first gear 122 is movable in the first direction toward and away from the first clutch 124 as described later. Specifically, when the first gear 122 is moved toward the first clutch 124 in the first direction, the first gear 122 is brought into contact with the first clutch 124 to prevent further movement of the first gear 122 in the first direction. When the first gear 122 attached to the shaft 121 is moved in the first direction away from the first clutch 124, a frame (not illustrated) supporting the one end portion of the shaft 121 prevents further movement of the first gear 122 in the first direction.

As illustrated in FIG. 4, the first gear 122 is in meshing engagement with the idle gear 12A. Hence, the first gear 122 is rotatable upon receipt of the driving force from the motor 11 through the idle gear 12A. The first gear 122 is a helical gear as illustrated in FIG. 5. The first gear 122 is rotatable about the first axis A11. The first gear 122 has one end face E1 and another end face E2 in the first direction. The other end face E2 is positioned between the one end face E1 and the first clutch 124 in the first direction. The flange 121D faces the one end face E1 of the first gear 122 in the first direction in the attached state of the first gear 122 to the shaft 121.

The first gear 122 is formed with a hole 122A. The hole 122A is positioned at a diametrically center portion of the first gear 122. The hole 122A has a circular shape. As illustrated in FIG. 6, the first support part 121A of the shaft 121 is fitted with the hole 122A. Thus, the first gear 122 is supported by the first support part 121A of the shaft 121. The first gear 122 is rotatable relative to the first support part 121A of the shaft 121.

Figure 2:
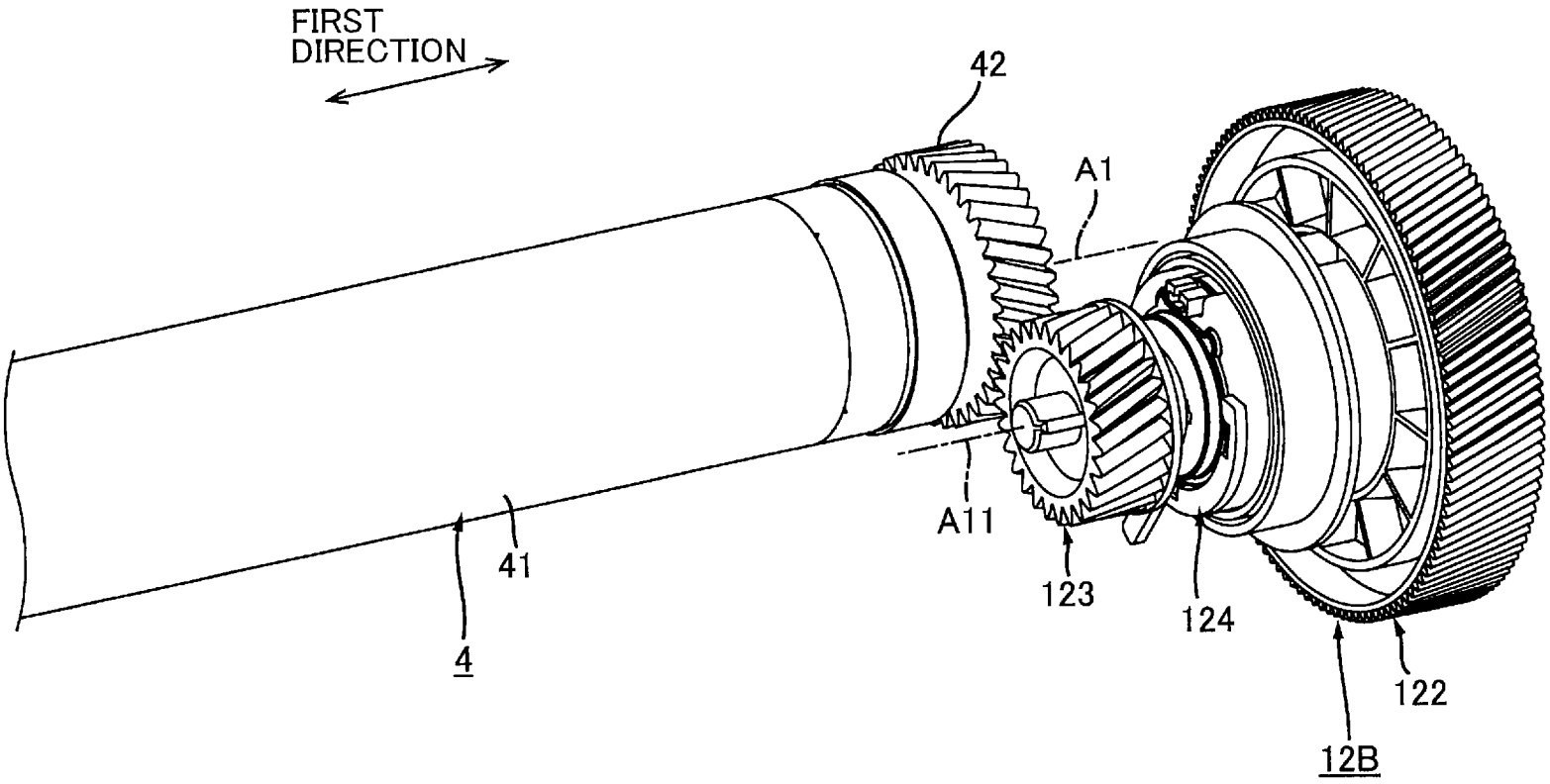
FIG. 2 is a perspective view of a photosensitive drum and a gear unit in the image-forming apparatus according to one embodiment.

As illustrated in FIG. 2, the second gear 123 is positioned apart from the first gear 122 in the first direction. The second gear 123 is a helical gear. The second gear 123 is in meshing engagement with the drum gear 42 to transmit the diving force to the photosensitive drum 4. The second gear 123 is rotatable about the first axis A11.

As illustrated in FIG. 5, the second gear 123 is formed with a hole 123A. The hole 123A is positioned at a diametrically center portion of the second gear 123. The hole 123A has a D-shape. The second gear 123 has an arcuate inner surface S21 and a flat inner surface S22 those defining the D shape of the hole 123A. The arcuate inner surface S21 extends in the rotational direction of the first gear 122. The flat inner surface S22 extends in the radial direction of the first gear 122. The flat inner surface S22 extends in the direction crossing the rotational direction of the first gear 122.

As illustrated in FIG. 6, the second support part 121B of the shaft 121 is fitted with the hole 123A. Thus, the second gear 123 is supported by the second support part 121B. The arcuate surface S1 of the second support part 121B faces the arcuate inner surface S21 of the second gear 123. The flat surface S2 of the second support part 121B faces the flat inner surface S22 of the second gear 123. With this structure, the second gear 123 is rotatable together with the shaft 121.

As illustrated in FIG. 2, the first clutch 124 is positioned between the first gear 122 and the second gear 123 in the first direction. The first clutch 124 is positioned apart from the first gear 122 in the first direction. The first clutch 124 is positioned apart from the second gear 123 in the first direction.

The first clutch 124 is configured to provide a first transmission state and a first transmission cutoff state switchable therebetween. In the first transmission state, the first clutch 124 allows power transmission from the first gear 122 to the second gear 123. In the first transmission cutoff state, the first clutch 124 shuts off the power transmission from the first gear 122 to the second gear 123.

The first clutch 124 of the embodiment is an electromagnetic clutch. The electromagnetic clutch includes a coil 124C, a rotor 124D, and an armature 124E. Upon energization of the coil 124C, the armature 124E is rotatable together with the rotor 124D, providing the first transmission state. Upon de-energization of the coil 124C, the armature 124E is rotatable relative to the rotor 124D (independent of the rotor 124D), providing the first transmission cutoff state.

As illustrated in FIGS. 5 and 6, the first clutch 124 further includes a hub 124A. The hub 124A connects the rotor 124D to the shaft 121. The hub 124A is rotatable together with the rotor 124D. The hub 124A is formed with a bore 124B having a D-shaped cross-section. The hub 124A has an inner arcuate surface S31 and an inner flat surface S32. The inner arcuate surface S31 and the inner flat surface S32 define the bore 124B. The inner arcuate surface S31 extends in the rotational direction of the first gear 122. The inner flat surface S32 extends in the radial direction of the first gear 122. The inner flat surface S32 extends in the direction crossing the rotational direction of the first gear 122.

The third support part 121C of the shaft 121 is fitted with the bore 124B. Hence, the first clutch 124 is supported by the third support part 121C of the shaft 121. The arcuate surface S11 of the third support part 121C faces the inner arcuate surface S31 of the hub 124A. The flat surface S12 of the third support part 121C faces the inner flat surface S32 of the hub 124A. Thus, the shaft 121 is rotatable together with the hub 124A and the rotor 124D.

As illustrated in FIG. 5, the first coupling 125 is positioned on the other end face E2 of the first gear 122. The first coupling 125 is integral with the first gear 122. Alternatively, the first coupling 125 may be a discrete member fixed to the first gear 122. The first coupling 125 is rotatable together with the first gear 122.

The first coupling 125 is formed with a first groove 125A and a second groove 125B. The first groove 125A and the second groove 125B extend in the radial direction of the first gear 122. Hereinafter, the direction in which the first groove 125A extends will be referred to as a second direction. That is, the second direction crosses the rotational direction of the first gear 122, and is coincident with the radial direction of the first gear 122. The first groove 125A is positioned apart from the hole 122A of the first gear 122 in the second direction.

The second groove 125B is positioned apart from the first groove 125A in the second direction. The first groove 125A is positioned apart from the hole 122A of the first gear 122 in the second direction. The second groove 125B is positioned opposite to the first groove 125A with respect to the hole 122A in the second direction (radial direction of the first gear 122). The second groove 125B is positioned opposite to the first groove 125A with respect to the first axis A11 in the second direction. The second groove 125B extends in the second direction. In other words, the second groove 125B extends in the same direction as the first groove 125A.

Figure 7:
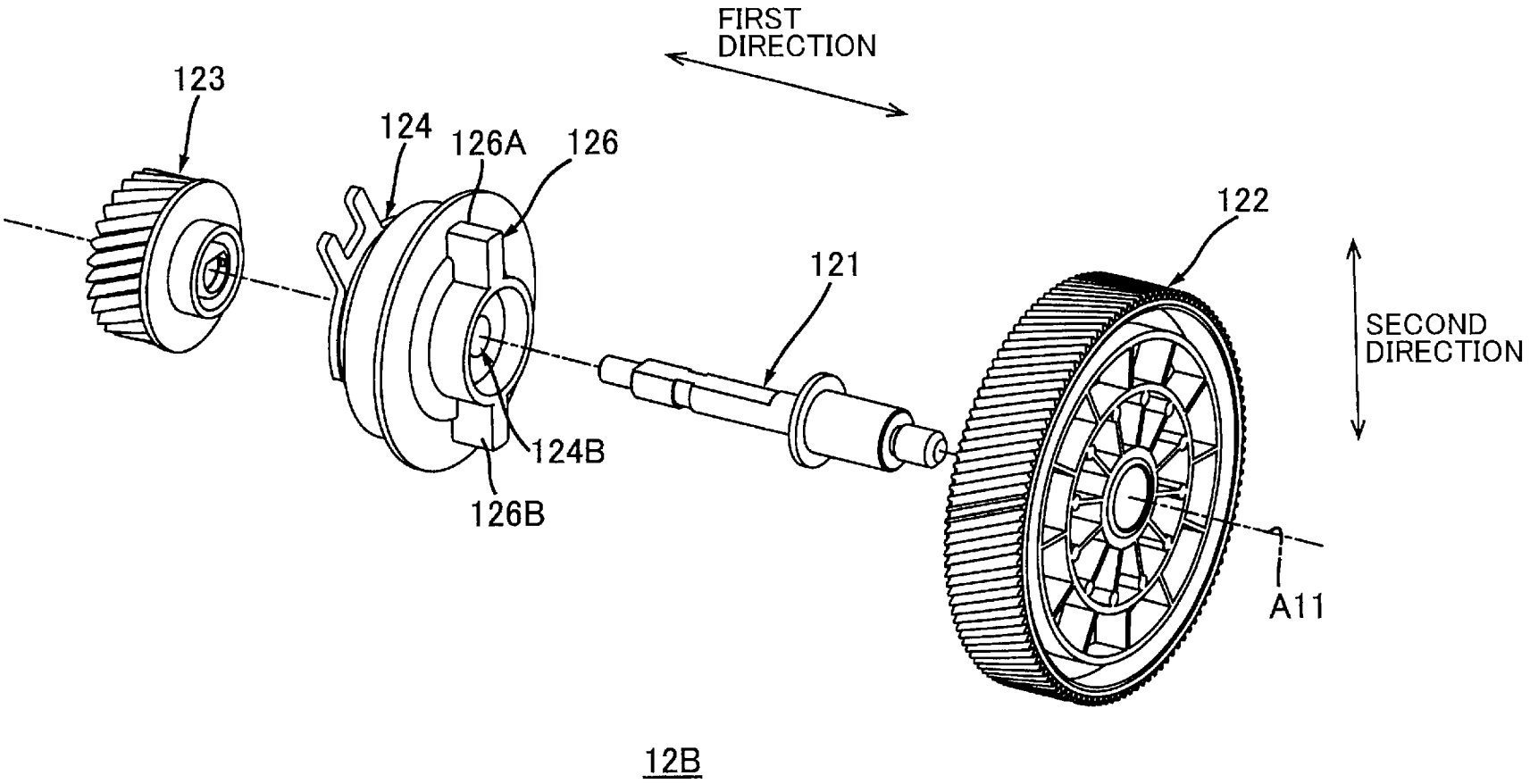
FIG. 7 is another exploded perspective view of the gear unit illustrated in FIG. 2 as viewed in a direction different from that in FIG. 5.

As illustrated in FIG. 7, the second coupling 126 is positioned between the first clutch 124 and the first gear 122 in the first direction. The second coupling 126 is fixed to the armature 124E of the first clutch 124. The second coupling 126 is rotatable together with the armature 124E of the first clutch 124.

The second coupling 126 is configured to be coupled with the first coupling 125. The second coupling 126 and the first coupling 125 are rotated together in a state where the second coupling 126 and the first coupling 125 are coupled to each other.

Specifically, the second coupling 126 includes a first protrusion 126A and a second protrusion 126B. The first protrusion 126A extends in the second direction. The first protrusion 126A is positioned apart from the bore 124B in the second direction. The first protrusion 126A is engaged with the first groove 125A of the first coupling 125 in the coupling state between the second coupling 126 and the first coupling 125.

The second protrusion 126B is positioned apart from the first protrusion 126A in the second direction. The second protrusion 126B is positioned apart from the bore 124B of the hub 124A in the second direction. The second protrusion 126B is positioned opposite to the first protrusion 126A with respect to the bore 124B in the second direction. The second protrusion 126B is positioned opposite to the first protrusion 126A with respect to the first axis A11 in the second direction. The second protrusion 126B extends in the second direction. In other words, the second protrusion 126B extends in the same direction as the first protrusion 126A. The second protrusion 126B is engaged with the second groove 125B of the first coupling 125 in the state where the second coupling 126 and the first coupling 125 are coupled to each other. The second coupling 126 is rotatable together with the first coupling 125 by the engagement between the first protrusion 126A and the first groove 125A and by the engagement between the second protrusion 126B and the second groove 125B.

In the coupling state between the second coupling 126 and the first coupling 125, the second coupling 126 is movable relative to the first coupling 125 in the first direction which is the extending direction of the first axis A11. Hence, the second coupling 126 is movable relative to the first coupling 125 in the first direction while the second coupling 126 rotates together with the first coupling 125. That is, the power transmission between the first coupling 125 and the second coupling 126 can be performed while the first coupling 125 and the second coupling 126 are allowed to be displaced from each other in the first direction.

Further, in the coupling state between the first coupling 125 and the second coupling 126, the second coupling 126 is movable relative to the first coupling 125 in the second direction which is the extending direction of the first protrusion 126A and the second protrusion 126B. That is, the second direction is a direction in which displacement of the second coupling 126 relative to the first coupling 125 is allowed (the second direction is also coincident with the radial direction of the first gear 122). Thus, the second coupling 126 can be displaced relative to the first coupling 125 in the second direction during co-rotation of the second coupling 126 and the first coupling 125. In other words, the second coupling 126 is displaceable with respect to the first coupling 125 in the radial direction of the first gear 122 when the second coupling 126 and the first coupling 125 are co-rotated. That is, the power transmission between the first coupling 125 and the second coupling 126 can be performed while displacement in the second direction between the first coupling 125 and the second coupling 126 is allowed.

The driving force is transmitted from the first gear 122 to the rotor 124D through the first coupling 125, the second coupling 126, and the armature 124E to rotate the rotor 124D when the first clutch 124 is in the first transmission state and the first gear 122 is rotating. Hence, the shaft 121 and the second gear 123 are rotated in accordance with the rotation of the rotor 124D. Accordingly, the driving force can be transmitted from the first gear 122 to the second gear 123 in the first transmission state of the first clutch 124.

On the other hand, the driving force is not transmitted from the armature 124E to the rotor 124D when the first clutch 124 is in the first transmission cutoff state and the first gear 122 is rotating. The rotor 124D is not rotated, and hence, the shaft 121 and the second gear 123 are not rotated. Accordingly, the driving force cannot be transmitted from the first gear 122 to the second gear 123 in the first transmission cutoff state of the first clutch 124.

2-3. Developing Gear Train 13

As illustrated in FIG. 3, the developing gear train 13 is configured to transmit the driving force of the motor 11 to the developing device 7 through the drum gear train 12. In other words, the developing gear train 13 is configured to transmit the driving force of the motor 11 to the developing roller 72 through the drum gear train 12. Specifically, the developing gear train 13 is configured to transmit the rotation of the first gear 122 to the developing roller 72.

Specifically, as illustrated in FIG. 4, the developing gear train 13 includes a plurality of idle gears 131 and 132, a developing gear 133, and a second clutch 134.

The idle gear 131 is in meshing engagement with the first gear 122 of the drum gear train 12. In other words, the developing gear train 13 is drivingly (mechanically) connected to the first gear 122. Hence, the driving force of the motor 11 is received by the developing gear train 13 through the drum gear train 12. The idle gear 132 is in meshing engagement with the idle gear 131.

The developing gear 133 is configured to transmit the driving force to the developing device 7. In other words, the developing gear 133 is configured to transmit the driving force to the developing roller 72.

The second clutch 134 is positioned between the idle gear 132 and the developing gear 133. The second clutch 134 of the present embodiment is an electromagnetic clutch. The second clutch 134 is configured to provide a second transmission state and a second transmission cutoff state switchable therebetween. In the second transmission state, the second clutch 134 performs power transmission from the idle gear 132 to the developing gear 133. Hence, the power transmission to the developing roller 72 can be performed in the second transmission state of the second clutch 134. On the other hand, in the second transmission cutoff state, the second clutch 134 interrupts the power transmission from the idle gear 132 to the developing gear 133. Hence, the power transmission to the developing roller 72 is cutoff in the second transmission cutoff state of the second clutch 134.

2-4. Fixing Gear Train 14

As illustrated in FIG. 3, the fixing gear train 14 is configured to transmit the driving force of the motor 11 to the fixing device 9. Specifically, as illustrated in FIG. 4, the fixing gear train 14 includes a plurality of idle gears 141, 142, 143, 144, and a fixing gear 145. The idle gear 141 is in meshing engagement with the output gear 112 of the motor 11. The idle gear 142 is in meshing engagement with the idle gear 141. The idle gear 143 is in meshing engagement with the idle gear 142. The idle gear 144 is in meshing engagement with the idle gear 143. The fixing gear 145 is in meshing engagement with the idle gear 144. The fixing gear 145 is configured to transmit the driving force to the fixing device 9.

2-5. Sensor 15

As illustrated in FIG. 1, the sensor 15 is configured to detect the sheet S moving from the registration roller 33 to the photosensitive drum 4. In the present embodiment, the sensor 15 is configured to contact the sheet S directing from the registration roller 33 to the photosensitive drum 4. The sensor 15 is switchable between an ON state and an OFF state. The sensor 15 outputs a signal in the ON state, and halts generation of the signal in the OFF state. The sensor 15 becomes the ON state upon contact of the sheet S with the sensor 15. The sensor 15 becomes the OFF state upon separation of the sheet S from the sensor 15.

2-6. Controller 16

As illustrated in FIG. 3, the controller 16 is electrically connected to the sensor 15, the motor 11, the first clutch 124, the second clutch 134, and the heater 91. The controller 16 is configured to receive the signal outputted from the sensor 15. Further, the controller 16 is configured to provide control to the motor 11, the first clutch 124, the second clutch 134, and the heater 91.

3. Control in the Image-Forming Apparatus 1

How the image-forming apparatus 1 is controlled will next be described with reference to FIGS. 1, 3, 8 and 9.

Figure 8:
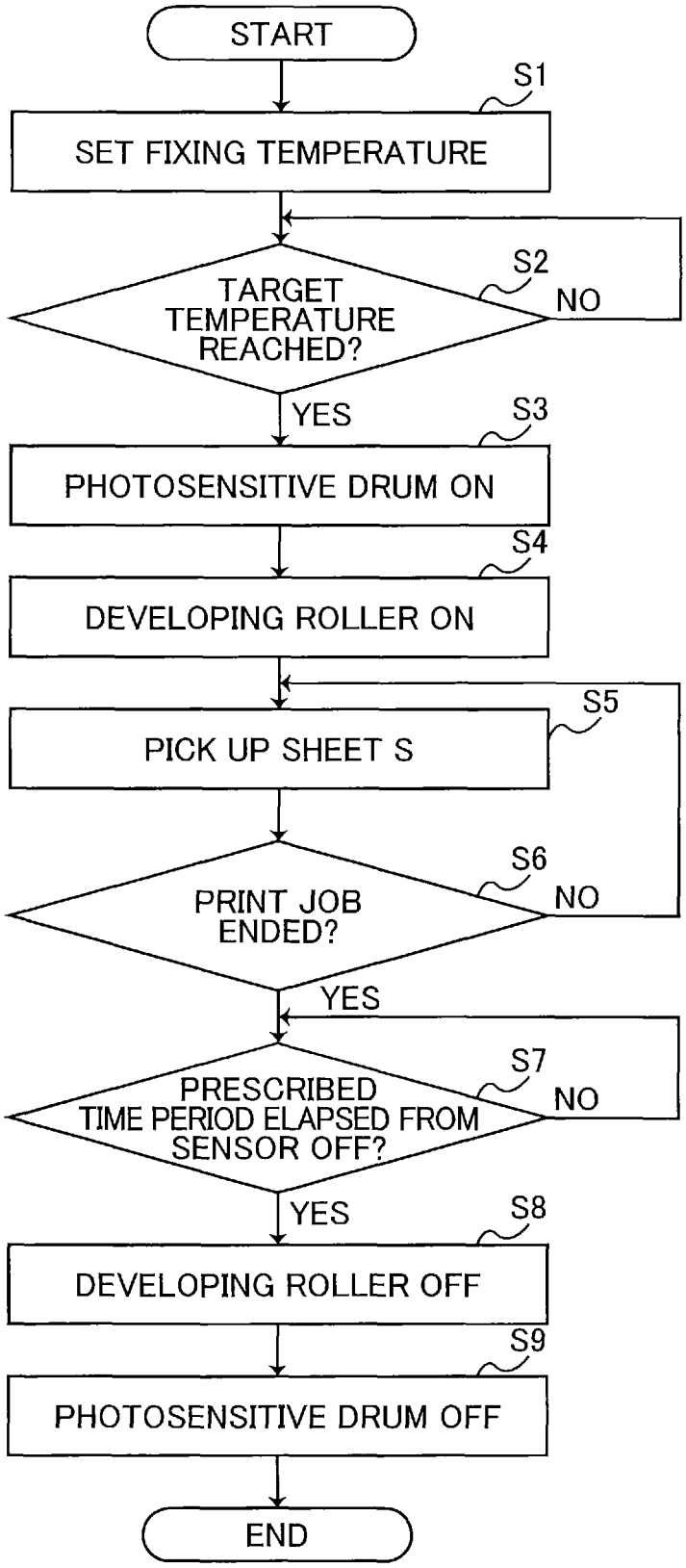
FIG. 8 is a flowchart for description of a control routine performed in the image-forming apparatus according to the embodiment.

As illustrated in FIG. 8, in response to receipt of a print job in the image-forming apparatus 1, the controller 16 sets a target temperature with respect to a fixing temperature (in S1). The fixing temperature is a temperature at which the fixing device 9 heats the sheet S. Specifically, in the present embodiment, the fixing temperature is a temperature of the surface of the heat roller 92. The surface temperature is detected by a temperature sensor (not illustrated). The controller 16 is configured to control the heater 91 so that the fixing temperature matches the target temperature.

Figure 9:
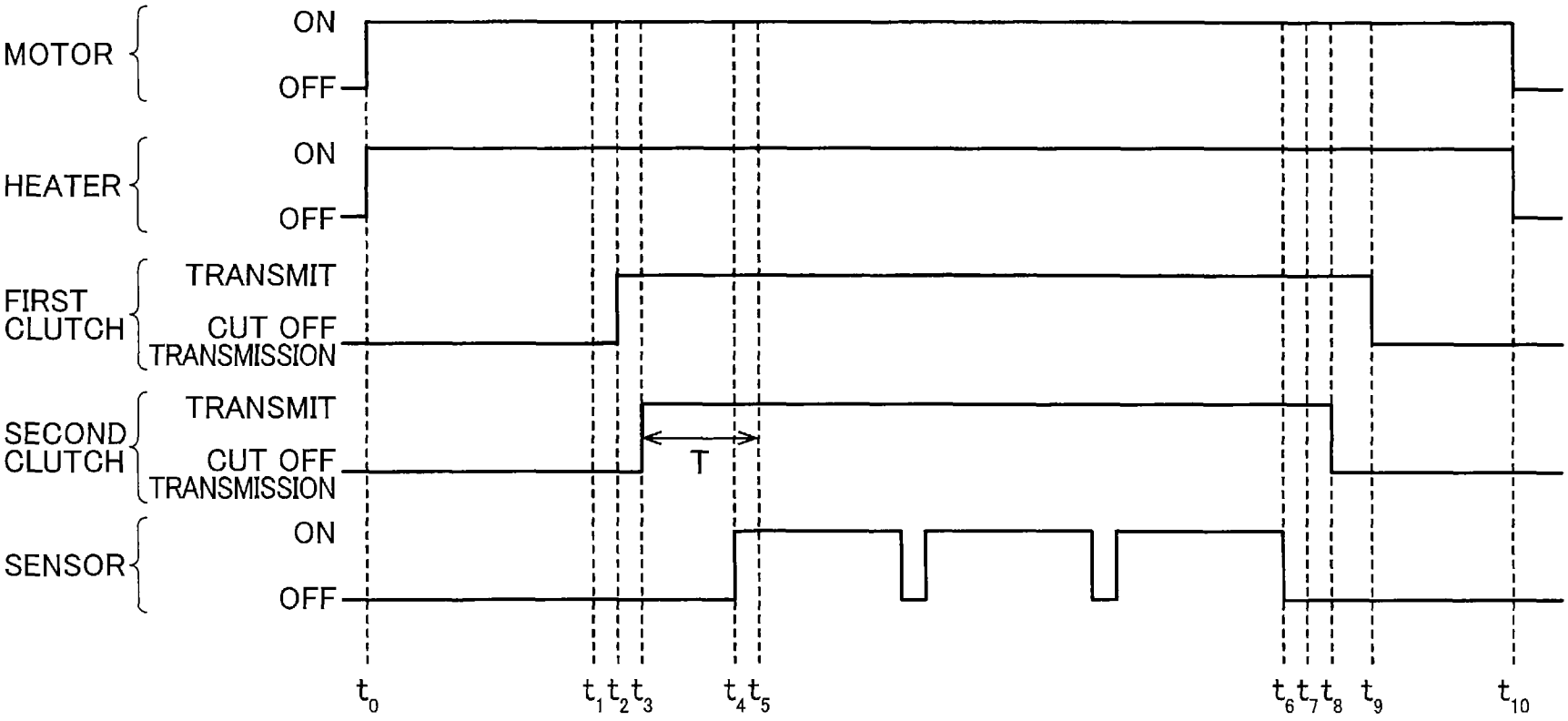
FIG. 9 is a timing chart for description of the control routine illustrated in FIG. 8.

At this time, at a point of time to illustrated in FIG. 9, the controller 16 permits the motor 11 to start rotating while the first clutch 124 is at the first transmission cutoff state and the second clutch 134 is at the second transmission cutoff state.

The rotation of the motor 11 is transmitted to the fixing device 9 through the fixing gear train 14 as illustrated in FIG. 3. The heat roller 92 starts rotating accordingly. On the other hand, the rotation of the motor 11 is not transmitted to the photosensitive drum 4 and the developing device 7, since the first clutch 124 is in the in the first transmission cutoff state and the second clutch 134 is in the second transmission cutoff state. Hence, the photosensitive drum 4 and the developing roller 72 are not rotated.

When the fixing temperature reaches the target temperature at a point of time $t_1$ (S2: YES), the controller 16 then permits the first clutch 124 to be switched from the first transmission cutoff state to the first transmission state at a point of time $t_2$ which is after the point of time $t_1$ (in S3). The photosensitive drum 4 thus starts rotating in S3.

Thereafter, at a point of time $t_3$ which is after the point of time $t_2$, the controller 16 permits the second clutch 134 to be switched from the second transmission cutoff state to the second transmission state (in S4). The developing roller 72 starts rotating in S4. That is, after the fixing temperature reaches the target temperature, the controller 16 permits the first clutch 124 to be switched to the first transmission state to start the power transmission to the photosensitive drum 4, and subsequently permits the second clutch 134 to be switched to the second transmission state to start the power transmission to the developing roller 72.

The controller 16 then permits the pick-up roller 32 to start rotating (in S5), so that the sheet S accommodated in the sheet accommodating portion 31 is picked up by the pick-up roller 32. The sheet S picked up by the pick-up roller 32 is then conveyed to the registration roller 33. The conveyance of the sheet S is then halted by the registration roller 33 when the sheet P contacts the registration roller 33. The controller 16 then permits the registration roller 33 to start rotating after elapse of a predetermined time period from the rotation start timing of the pick-up roller 32. As a result, the sheet S stopped at the registration roller 33 is then conveyed toward the photosensitive drum 4 by the rotation of the registration roller 33.

A leading edge of the sheet S conveyed by the registration roller 33 is brought into contact with the sensor 15 at a point of time $t_4$ which is after the point of time $t_3$. Hence, the sensor 15 is rendered ON at the point of time $t_4$. The leading edge of the sheet S conveyed by the registration roller 33 is then brought into contact with the photosensitive drum 4 at a point of time $t_5$. In other words, the controller 16 permits the second clutch 134 to be switched to the second transmission state at the point of time $t_3$ which is before the point of time $t_5$. Here, a time span T from the point of time $t_3$ to the point of time $t_5$ is set to be greater than a time period during which the photosensitive drum 4 performs one-time rotation.

Thereafter, the controller 16 determines whether the print job is ended (in S6). In a case where the print job is not ended (S6: NO), the controller 16 again permits the pick-up roller 32 to rotate (in S5). On the other hand, in a case where the print job is ended (S6: YES), the last sheet S used in the print job leaves the sensor 15 at a point of time $t_6$. The sensor 15 is thus rendered OFF at the point of time $t_6$. The last sheet S then leaves the photosensitive drum 4 at a point of time $t_7$ after the last sheet S left the sensor 15 at the point of time $t_6$.

At a point of time $t_8$ after elapse of a predetermined time period from the point of time $t_6$ at which the sensor 15 no longer detects the last sheet S (S7: YES), the controller 16 permits the second clutch 134 to be switched to the second transmission cutoff state (in S8). Hence, the rotation of the developing roller 72 is stopped in S8.

Then, at a point of time $t_9$ which is after the point of time $t_8$, the controller 16 permits the first clutch 124 to be switched to the first transmission cutoff state (in S9). The rotation of the photosensitive drum 4 is thus stopped in S9. That is, the controller 16 permits the first clutch 124 to be switched to the first transmission cutoff state to cut off the power transmission to the photosensitive drum 4, after the second clutch 134 is switched to the second transmission cutoff state to cut off the power transmission to the developing roller 72.

The controller 16 then permits the heater 91 to be turned OFF at a point of time $t_{10}$, and permits the motor 11 to stop rotating at the point of time $t_{10}$.

4. Operational and Technical Advantages (1) According to the image-forming apparatus 1 described above, the gear unit 12B includes: the first gear 122 configured to receive the driving force from the motor 11; the second gear 123 configured to transmit the driving force to the photosensitive drum 4; and the first clutch 124 configured to cut off the transmission of the driving force from the first gear 122 to the second gear 123, as illustrated in FIG. 2. With this structure, the rotation of the photosensitive drum 4 can be stopped at a desired timing by switching the first clutch 124 from the first transmission state to the first transmission cutoff state.

(2) As illustrated in FIGS. 5 and 7, the gear unit 12B includes the first coupling 125 and the second coupling 126. The first coupling 125 is rotatable together with the first gear 122. The second coupling 126 is rotatable together with the armature 124E of the first clutch 124. The second coupling 126 is engageable with the first coupling 125. In the coupling state between the second coupling 126 and the first coupling 125, the second coupling 126 is rotatable together with the first coupling 125. That is, the armature 124E of the first clutch 124 is connectable through the first coupling 125 and the second coupling 126 to the first gear 122 configured to receive the driving force from the motor 11.

Here, assume a comparative configuration where the armature 124E is directly connected to the first gear 122. In this comparative example, it is likely that the armature 124E may be pulled or pushed by the first gear 122, so that a load acting in the first direction may be directly applied from the first gear 122 to the armature 124E. Specifically, in the configuration where the armature 124E is directly connected to the first gear 122, since the first gear 122 is a helical gear, the load acting in the first direction may be applied from the first gear 122 to the armature 124E due to thrusting force of the first gear 122. If the load other than the torque for rotations is applied to the armature 124E from the first gear 122, degradation of the first clutch 124 (such as frictional wearing of the mechanical components of the first clutch 124) is likely to be promoted.

In contrast, in the image-forming apparatus 1 according to the embodiment, the armature 124E is connected to the first gear 122 through the first coupling 125 and the second coupling 126. In other words, the first coupling 125 and the second coupling 126 are positioned between the first gear 122 and the first clutch 124.

With this structure, application of the load acting in the first direction from the first gear 122 to the armature 124E can be restrained, since the first coupling 125 and the second coupling 126 are relatively movable in the first direction. That is, application of load other than the torque from the first gear 122 to the armature 124E can be restrained. Accordingly, degradation of the first clutch 124 can be restrained, and a prolonged service life of the first clutch 124 can be realized.

(3) The second coupling 126 is movable in the radial direction of the first gear 122 relative to the first coupling 125 while the second coupling 126 is rotating together with the first coupling 125. Here, a slight gap is provided between the inner surface of the hole 122A of the first gear 122 and the peripheral surface of the first support part 121A of the shaft 121. Therefore, the rotation axis of the first gear 122 may be slightly displaced in the radial direction thereof in the rotating state of the first gear 122.

To this effect, since the second coupling 126 is movable in the radial direction of the first gear 122 relative to the first coupling 125 in the present embodiment, load acting in the radial direction is less likely to be applied from the first gear 122 to the armature 124E than otherwise. That is, application of load other than the torque from the first gear 122 to the armature 124E can be restrained. As a result, degradation of the first clutch 124 can be restrained, and a prolonged service life of the first clutch 124 can be obtained.

(4) The first clutch 124 is positioned between the first gear 122 and the second gear 123, as illustrated in FIG. 2. In other words, the first gear 122, the first clutch 124, and the second gear 123 are arrayed with one another along the first axis A11.

With this structure, a compact layout of the first gear 122, the first clutch 124, and the second gear 123 in a direction crossing the first axis A11 is attainable. This is in high contrast to an arrangement where the first gear 122, the first clutch 124, and the second gear 123 are arrayed in a direction crossing the first axis A11. As a result, the first clutch 124 can be provided in the drum gear train 12 without increase in size of the drum gear train 12.

(5) In the image-forming apparatus 1 according to the embodiment, the developing gear train 13 includes the second clutch 134. The developing gear train 13 can transmit the driving force to the developing roller 72 in the second transmission state of the second clutch 134. Transmission of the driving force to the developing roller 72 is cut off in the second transmission cutoff state of the second clutch 134. With this structure, the rotation of the developing roller 72 can be stopped at a desired timing by switching the second clutch 134 from the second transmission state to the second transmission cutoff state.

(6) The image-forming apparatus 1 according to the embodiment includes the fixing device 9 and the fixing gear train 14, as illustrated in FIG. 3. The fixing gear train 14 is configured to transmit the driving force from the motor 11 to the fixing device 9. That is, the rotation of the photosensitive drum 4 can be stopped at a desired timing while the fixing device 9 is in a driving state thereof.

(7) As illustrated in FIG. 9, the fixing device 9 can be driven by driving the motor 11 in the state where the first clutch 124 is in the first transmission cutoff state and the second clutch 134 is in the second transmission cutoff state. That is, the fixing device 9 can be driven while the rotations of the photosensitive drum 4 and the developing roller 72 are being halted. This configuration enables the rotations of the photosensitive drum 4 and the developing roller 72 to be stopped until the fixing temperature reaches the target temperature, i.e., during a time span from the point of time to to the point of time $t_1$.

Hence, friction is not generated between the photosensitive drum 4 and the developing roller 72 during the time span from the point of time to to the point of time $t_1$. As a result, degradation of the photosensitive drum 4 can be obviated during the time span from the point of time to to the point of time $t_1$.

Further, after the fixing temperature reaches the target temperature at the point of time $t_1$ (S2: YES), the photosensitive drum 4 is caused to start rotating at the point of time $t_2$ (in S3), and thereafter, the developing roller 72 is caused to start rotating at the point of time $t_3$ (in S4). In this way, the developing roller 72 is configured not to rotate while the rotation of the photosensitive drum 4 is stopped. This configuration can prevent the rotating developing roller 72 from intensively rubbing against only part of the stationary photosensitive drum 4, thereby preventing localized frictional wearing of the photosensitive drum 4. As a result, degradation at the converged part of the photosensitive drum 4 can be obviated.

(8) In the image-forming apparatus 1 according to the embodiment, the leading edge of the sheet S conveyed by the registration roller 33 is brought into contact with the photosensitive drum 4 at the point of time $t_5$ (see FIG. 9). The controller 16 permits the second clutch 134 to be switched to the second transmission state at the point of time $t_3$ (which is earlier than the point of time $t_5$). That is, the developing roller 72 can start rotating at the point of time $t_3$, after the photosensitive drum 4 starts rotating at the point of time $t_2$ and before the sheet S is brought into contact with the photosensitive drum 4 at the point of time $t_5$.

(9) Referring to FIG. 9, the time span T from the point of time $t_3$ to the point of time $t_5$ is greater than the time period required for the photosensitive drum 4 to rotate once. With this configuration, an entire peripheral surface of the photosensitive drum 4 can be charged by the charger 5 during the time span T from the point of time $t_3$ (at which the developing roller 72 starts rotating) to the point of time $t_5$ (at which the sheet S is brought into contact with the photosensitive drum 4).

(10) The sensor 15 is configured to detect the sheet S which is being conveyed from the registration roller 33 toward the photosensitive drum 4. As illustrated in FIG. 9, the controller 16 permits the second clutch 134 to be switched to the second transmission cutoff state the point of time $t_8$ (in S8) upon elapse of the predetermined time period from the point of time $t_6$ at which the sensor 15 no longer detects the last sheet S associated with the print job (S6: YES, S7: YES in FIG. 8). In this way, the rotation of the developing roller 72 is halted when printing on the sheet S is not performed, thereby restraining degradation of toner.

(11) Referring to FIG. 9, the controller 16 permits the first clutch 124 to be switched to the first transmission cutoff state to cut off the power transmission to the photosensitive drum 4 at the point of time $t_9$ (S9) after the controller 16 permits the second clutch 134 to be switched to the second transmission cutoff state to cut off the power transmission to the developing roller 72 at the point of time $t_8$ (S8).

With this structure, the rotation of the photosensitive drum 4 as well as the rotation of the developing roller 72 are both stopped in the state where printing on the sheet S is not performed. Degradation of the photosensitive drum 4 can be suppressed accordingly. Further, localized degradation of the photosensitive drum 4 can also be restrained, because the rotation of the photosensitive drum 4 can be stopped after the rotation of the developing roller 72 is stopped.

5. Modifications (1) The gear unit 12B may not include the shaft 121 that collectively supports the first gear 122, the second gear 123, and the first clutch 124. For example, each of the first gear 122, the second gear 123, and the first clutch 124 may be supported independently of each other by the housing 2.

(2) The image-forming apparatus 1 may further include a second sensor configured to detect the sheet S moving from the pick-up roller 32 toward the registration roller 33. In this case, the controller 16 may permit the second clutch 134 to be switched to the second transmission cutoff state upon elapse of a predetermined time period from a timing at which the second sensor does not detect the sheet S any longer.

(3) The image-forming apparatus 1 may further include a third sensor configured to detect the sheet S picked up by the pick-up roller 32. In this case, the controller 16 may permit the second clutch 134 to be switched to the second transmission cutoff state upon elapse of a predetermined time period from a timing at which the third sensor no longer detects the sheet S.

(4) The first clutch 124 and the second clutch 134 may be mechanical sensors. instead of the electromagnetic sensors.

(5) In the above-described modifications (1)-(4), the same functions and technical advantages as the above-described embodiment can be obtained.

While the description has been made in detail with reference to the embodiments, it would be apparent to those skilled in the art that many modifications and variations may be made thereto.

Remarks

The image-forming apparatus 1 is an example of an image-forming apparatus. The photosensitive drum 4 is an example of a photosensitive drum. The motor 11 is an example of a motor. The drum gear train 12 is an example of a drum gear train. The first gear 122 is an example of a first gear. The second gear 123 is an example of a second gear. The first clutch 124 is an example of a first clutch. The second clutch 134 is an example of a second clutch. The first coupling 125 is an example of a first coupling. The second coupling 126 is an example of a second coupling. The shaft 121 is an example of a shaft. The developing roller 72 is an example of a developing roller. The fixing device 9 is an example of a fixing device. The developing gear train 13 is an example of a developing gear train. The fixing gear train 14 is an example of a fixing gear train. The registration roller 33 is an example of a registration roller. The controller 16 is an example of a controller.

What is claimed is:

1. An image-forming apparatus comprising:
a photosensitive drum;
a motor; and
a drum gear train configured to transmit a driving force from the motor to the photosensitive drum, the drum gear train comprising:
a first gear rotatable about a first axis upon receipt of the driving force, the first gear being a helical gear;
a second gear rotatable about the first axis and configured to receive the driving force from the first gear and to transmit the driving force to the photosensitive drum; and
a first clutch switchable between a first transmission state where the driving force is transmitted from the first gear to the second gear and a first transmission cutoff state where transmission of the driving force from the first gear to the second gear is cut off, the first clutch being an electromagnetic clutch comprising an armature,
wherein the drum gear train further comprises:
a first coupling rotatable together with the first gear, the first coupling having a first groove and a second groove each being recessed in a direction along the first axis; and
a second coupling rotatable together with the armature and configured to be coupled with the first coupling, the second coupling being rotatable together with the first coupling upon coupling therewith, the second coupling comprising a first protrusion and a second protrusion respectively engageable with the first groove and the second groove upon coupling of the second coupling with the first coupling, and
wherein the second coupling is movable relative to the first coupling in the direction along the first axis in a state where the second coupling rotates together with the first coupling.

2. The image-forming apparatus according to claim 1, wherein the first coupling is integral with the first gear.

3. The image-forming apparatus according to claim 1, wherein the second coupling is fixed to the armature.

4. The image-forming apparatus according to claim 1, wherein the second coupling is movable relative to the first coupling in a radial direction of the first gear in a state where the second coupling rotates together with the first coupling.

5. The image-forming apparatus according to claim 1, wherein the first clutch is positioned between the first gear and the second gear.

6. The image-forming apparatus according to claim 1, further comprising:
a developing roller; and
a developing gear train configured to receive the driving force through the drum gear train and to transmit the driving force to the developing roller.

7. The image-forming apparatus according to claim 6, wherein the developing gear train is drivingly connected to the first gear.

8. The image-forming apparatus according to claim 6, wherein the developing gear train comprises a second clutch switchable between a second transmission state where the driving force is transmitted to the developing roller and a second transmission cutoff state where transmission of the driving force to the developing roller is cut off.

9. The image-forming apparatus according to claim 1, further comprising:
a fixing device; and
a fixing gear train configured to transmit the driving force to the fixing device.

10. The image-forming apparatus according to claim 1, further comprising a shaft extending along the first axis,
wherein the first gear, the second gear, and the first clutch are supported by the shaft.

11. The image-forming apparatus according to claim 1, further comprising:
a developing roller;
a fixing device comprising a heater, the fixing device being configured to heat a sheet at a fixing temperature;
a developing gear train configured to transmit the driving force from the first gear to the developing roller, the developing gear train comprising a second clutch switchable between a second transmission state where the driving force is transmitted from the first gear to the developing roller and a second transmission cutoff state where transmission of the driving force from the first gear to the developing roller is cut off;
a fixing gear train configured to transmit the driving force from the motor to the fixing device; and
a controller,
wherein the controller is configured, after the fixing temperature reaches a target temperature, to:
permit the first clutch to be switched to the first transmission state to start transmitting the driving force to the photosensitive drum; and
subsequently permit the second clutch to be switched to the second transmission state to start transmitting the driving force to the developing roller.

12. The image-forming apparatus according to claim 11, further comprising a registration roller configured to convey the sheet to the photosensitive drum,
wherein:
a leading edge of the sheet conveyed by the registration roller contacts the photosensitive drum at a first point of time; and
the controller is further configured to permit the second clutch to be switched to the second transmission state at a second point of time before the first point of time.

13. The image-forming apparatus according to claim 12, wherein a time span from the second point of time to the first point of time is greater than a time period required for the photosensitive drum to make one rotation.

14. The image-forming apparatus according to claim 12, further comprising a sensor configured to detect the sheet conveyed from the registration roller to the photosensitive drum,
wherein the controller is further configured to permit the second clutch to be switched to the second transmission cutoff state to cut off the transmission of the driving force to the developing roller upon elapse of a predetermined time period from a point of time at which the sensor no longer detects the sheet.

15. The image-forming apparatus according to claim 14, wherein the controller is further configured to permit the first clutch to be switched to the first transmission cutoff state to cut off the transmission of the driving force to the photosensitive drum after the second clutch is switched to the second transmission cutoff state.

16. The image-forming apparatus according to claim 11, further comprising a shaft extending along the first axis,
wherein the first gear, the second gear, and the first clutch are supported by the shaft.

17. The image-forming apparatus according to claim 11, wherein the first clutch is positioned between the first gear and the second gear.

18. The image-forming apparatus according to claim 11, wherein the second clutch is an electromagnetic clutch.

19. An image-forming apparatus comprising a photosensitive drum a developing roller;

a fixing device comprising a heater, the fixing device being configured to heat a sheet at a fixing temperature;

a motor;

a drum gear train configured to transmit a driving force from the motor to the photosensitive drum, the drum gear train comprising:

a first gear rotatable about a first axis upon receipt of the driving force, the first gear being a helical gear;

a second gear rotatable about the first axis and configured to receive the driving force from the first gear and to transmit the driving force to the photosensitive drum; and a first clutch switchable between a first transmission state where the driving force is transmitted from the first gear to the second gear and a first transmission cutoff state where transmission of the driving force from the first gear to the second gear is cut off, the first clutch being an electromagnetic clutch comprising an armature;

a developing gear train configured to transmit the driving force from the first gear to the developing roller, the developing gear train comprising a second clutch switchable between a second transmission state where the driving force is transmitted from the first gear to the developing roller and a second transmission cutoff state where transmission of the driving force from the first gear to the developing roller is cut off;

a fixing gear train configured to transmit the driving force from the motor to the fixing device; and a controller, wherein the drum gear train further comprises:

a first coupling rotatable together with the first gear, the first coupling having a first groove and a second groove each being recessed in a direction along the first axis; and a second coupling rotatable together with the armature and configured to be coupled with the first coupling, the second coupling being rotatable together with the first coupling upon coupling therewith, the second coupling comprising a first protrusion and a second protrusion respectively engageable with the first groove and the second groove upon coupling of the second coupling with the first coupling, and wherein the second coupling is movable relative to the first coupling in the direction along the first axis in a state where the second coupling rotates together with the first coupling, and wherein the controller is configured, after the fixing temperature reaches a target temperature, to:

permit the first clutch to be switched to the first transmission state to start transmitting the driving force to the photosensitive drum; and subsequently permit the second clutch to be switched to the second transmission state to start transmitting the driving force to the developing roller.

20. The image-forming apparatus according to claim 19, further comprising a registration roller configured to convey the sheet to the photosensitive drum, wherein a leading edge of the sheet conveyed by the registration roller contacts the photosensitive drum at a first point of time, and the controller is further configured to permit the second clutch to be switched to the second transmission state at a second point of time before the first point of time.

21. The image-forming apparatus according to claim 20, wherein a time span from the second point of time to the first point of time is greater than a time period required for the photosensitive drum to make one rotation.

22. The image-forming apparatus according to claim 20, further comprising a sensor configured to detect the sheet conveyed from the registration roller to the photosensitive drum, wherein the controller is further configured to permit the second clutch to be switched to the second transmission cutoff state to cut off the transmission of the driving force to the developing roller upon elapse of a predetermined time period from a point of time at which the sensor no longer detects the sheet.

23. The image-forming apparatus according to claim 22, wherein the controller is further configured to permit the first clutch to be switched to the first transmission cutoff state to cut off the transmission of the driving force to the photosensitive drum after the second clutch is switched to the second transmission cutoff state.

24. The image-forming apparatus according to claim 19, further comprising a shaft extending along the first axis, wherein the first gear, the second gear, and the first clutch are supported by the shaft.

25. The image-forming apparatus according to claim 19, wherein the first clutch is positioned between the first gear and the second gear.

26. The image-forming apparatus according to claim 19, wherein the second clutch is an electromagnetic clutch.

* * * * *